US011939756B1

(12) United States Patent
Clawson

(10) Patent No.: US 11,939,756 B1
(45) **Date of Patent: *Mar. 26, 2024**

(54) SHOWER HAIR RECEPTACLE

(71) Applicant: Emily Clawson, Nashville, TN (US)

(72) Inventor: Emily Clawson, Nashville, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/334,823

(22) Filed: Jun. 14, 2023

Related U.S. Application Data

(63) Continuation of application No. 17/648,943, filed on Jan. 26, 2022, now Pat. No. 11,680,396.

(60) Provisional application No. 63/199,799, filed on Jan. 26, 2021.

(51) Int. Cl.
*E03C 1/26* (2006.01)

(52) U.S. Cl.
CPC ..... *E03C 1/26* (2013.01)

(58) Field of Classification Search
CPC ..... E03C 1/26; E03C 1/264
USPC ..... 4/515, 559, 605, 652, 661, 256.1, 4/288–292; 15/104.5, 187
See application file for complete search history.

(56) References Cited

U.S. PATENT DOCUMENTS 5,241,714 A 9/1993 Barry
7,302,715 B1 12/2007 Finell
10,765,198 B2 9/2020 Watne et al.
11,272,781 B2 3/2022 Rose et al.
11,680,396 B1 * 6/2023 Clawson ..... E03C 1/26 4/515
2006/0168720 A1 8/2006 Dellarocca
2021/0348372 A1 * 11/2021 Patton ..... E03C 1/264

OTHER PUBLICATIONS

"Shower Cat," URL: <https://showercat.co/>, last accessed May 9, 2022, archived at the Wayback Machine at <https://Web.archive.org/web/20220509195932/https://showercatco/> on May 9, 2022.
"The Hairball—A receptacle to dispose of hair while in the shower," URL: <https://thehairball.shop/>, last accessed May 9, 2022, archived at the Wayback Machine at <https://web.archive.org/web/20220402211444/https://thehairball.shop/> on Apr. 2, 2022.
"INVIHUG, Shower Hair Catcher Wall" URL: <https://www.amazon.com/INVIHUG-FULL-HOUSE-Shower-Catcher/dp/B0BF5DD44X/?th=1>, last accessed Sep. 20, 2023, archived at the Wayback Machine at <https://web.archive.org/web/20230920202447/https://www.amazon.com/INVIHUG-FULL-HOUSE-Shower-Catcher/dp/B0BF5DD44X/?th=1> on Sep. 20, 2023 (9 pages).
"Hair Catcher" URL: < https://www.amazon.com/Reusable-Collector-Protector-Silicone-Bathroom/dp/B0BG67RFTH?th=1>, last accessed Sep. 20, 2023, archived at the Wayback Machine at <https://web.archive.org/web/20230920202239/https://www.amazon.com/Reusable-Collector-Protector-Silicone-Bathroom/dp/B0BG67RFTH?th=1> on Sep. 20, 2023 (7 pages).

* cited by examiner

*Primary Examiner* — Tuan N Nguyen
(74) *Attorney, Agent, or Firm* — Lowenstein Sandler LLP

(57) ABSTRACT

A shower hair receptacle may include a sleeve. The sleeve may include an enclosure, at least one opening in the enclosure, at least one flap selectively disposable over the at least one opening, or a rake edge disposed inside the enclosure. The rake edge may catch hair disposed in the enclosure by a user and remove the hair from the grasp of the user.

19 Claims, 8 Drawing Sheets

SHOWER HAIR RECEPTACLE

CROSS-REFERENCES TO RELATED APPLICATIONS

This application is a continuation of U.S. patent application Ser. No. 17/648,943, entitled "Shower Hair Receptacle," filed on Jan. 26, 2022, and which issued as U.S. Pat. No. 11,680,396 on Jun. 20, 2023; which claims priority to U.S. Provisional Patent Application No. 63/199,799, entitled "Shower Hair Receptacle," filed Jan. 26, 2021, and which is expired. The entirety of these applications is incorporated by reference.

TECHNICAL FIELD

The present disclosure generally relates to shower products, and more particularly to a shower hair receptacle.

BACKGROUND

When a person with long hair washes his or her hair in the shower, strands of hair often become detached from his or her head. The person may stick the wet, detached hair to the shower wall and continue showering. This clutters up the shower wall and causes the shower to become untidy. The person may, instead, wash the detached hair out of his or her hands, but this causes the detached hair to go down the shower drain and clog the drainage pipe.

What is needed then is a shower hair receptacle.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

One aspect of the disclosure includes a shower hair receptacle. The shower hair receptacle may include a sleeve. The sleeve may include an enclosure, at least one opening in the enclosure, at least one flap selectively disposable over the at least one opening, or a rake edge disposed inside the enclosure. The shower hair receptacle may include at least one adhesive disposed on a back side of an exterior portion of the sleeve. The rake edge may catch hair disposed in the enclosure by a user and remove the hair from the grasp of the user.

Another aspect of the disclosure includes another shower hair receptacle. The shower hair receptacle may include a sleeve. The sleeve may include an enclosure. The enclosure may include an upper portion and a lower portion. The upper portion may be disposed above the lower portion. The sleeve may include a first opening disposed in the upper portion of the enclosure. The sleeve may include a second opening disposed in the lower portion of the enclosure. The sleeve may include a first flap selectively disposable over the first opening. The sleeve may include a second flap selectively disposable over the second opening. The sleeve may include a rake edge disposed inside the enclosure. The rake edge may include a first plurality of protrusions disposed on a first interior wall of the enclosure. The rake edge may include a second plurality of protrusions disposed on a second interior wall of the enclosure. The shower hair receptacle may include at least one adhesive disposed on a back side of an exterior portion of the sleeve. The rake edge may catch hair disposed in the enclosure by a user and remove the hair from the grasp of the user.

Another aspect of the disclosure includes a method. The method may include a method for operating a shower hair receptacle. The method may include adhering a shower hair receptacle to a shower wall. The shower hair receptacle may include a sleeve. The sleeve may include an enclosure, at least one opening in the enclosure, at least one flap selectively disposable over the at least one opening, or a rake edge disposed inside the enclosure. The shower hair receptacle may include at least one adhesive disposed on a back side of an exterior portion of the sleeve. The method may include inserting a hand into the enclosure through the at least one opening. The hand may selectively grasp a plurality of hairs. The method may include releasing the plurality of hairs and removing the hand from the enclosure. The rake edge may be operable to grasp the plurality of hairs. The method may include removing the shower hair receptacle from the shower wall. The method may include turning the shower hair receptacle inside out. The method may include removing the plurality of hairs from the rake edge.

Numerous other objects, advantages and features of the present disclosure will be readily apparent to those of skill in the art upon a review of the following drawings and description of various embodiments.

DETAILED DESCRIPTION

Figure 1:
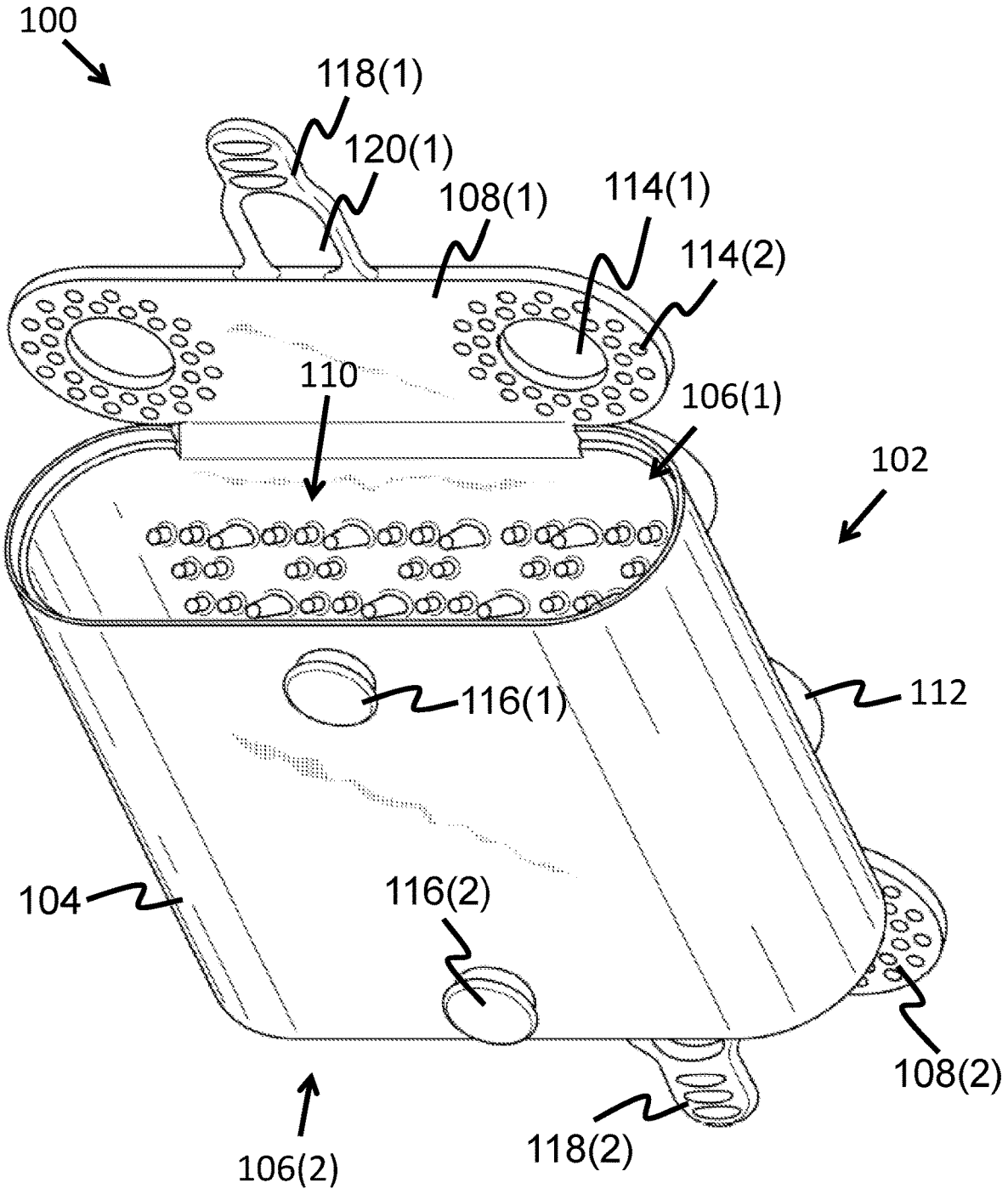
FIG. 1 is a perspective view illustrating one embodiment of a shower hair receptacle.

While the making and using of various embodiments of the present disclosure are discussed in detail below, it should be appreciated that the present disclosure provides many applicable inventive concepts that are embodied in a wide variety of specific contexts. The specific embodiments discussed herein are merely illustrative of specific ways to make and use the disclosure and do not delimit the scope of the disclosure. Those of ordinary skill in the art will recognize numerous equivalents to the specific apparatus and methods described herein. Such equivalents are considered to be within the scope of this disclosure and are covered by the claims.

In the drawings, not all reference numbers are included in each drawing, for the sake of clarity. In addition, positional terms such as "upper," "lower," "side," "top," "bottom," etc. refer to the apparatus when in the orientation shown in the drawing. A person of skill in the art will recognize that the apparatus can assume different orientations when in use. The terms, "in one embodiment," "in some embodiments," "in one or more embodiments," "in other embodiments," and "in another embodiment," all mean "in at least one embodiment, but not necessarily in all embodiments." The term "or" is not exclusive unless otherwise noted. The term "include," "includes," and "including" all mean "including, but not limited to," unless otherwise noted.

Multiple elements of the same or a similar type may be referred to as "Elements 102(1)-(n)" where n may include a number. Referring to one of the elements as "Element 102" refers to any single element of the Elements 102(1)-(n). Additionally, referring to different elements "First Elements 102(1)-(n)" and "Second Elements 104(1)-(n)" does not necessarily mean that there must be the same number of First Elements as Second Elements and is equivalent to "First Elements 102(1)-(n)" and "Second Elements (1)-(m)" where m is a number that may be the same or may be a different number than n.

Figure 2:
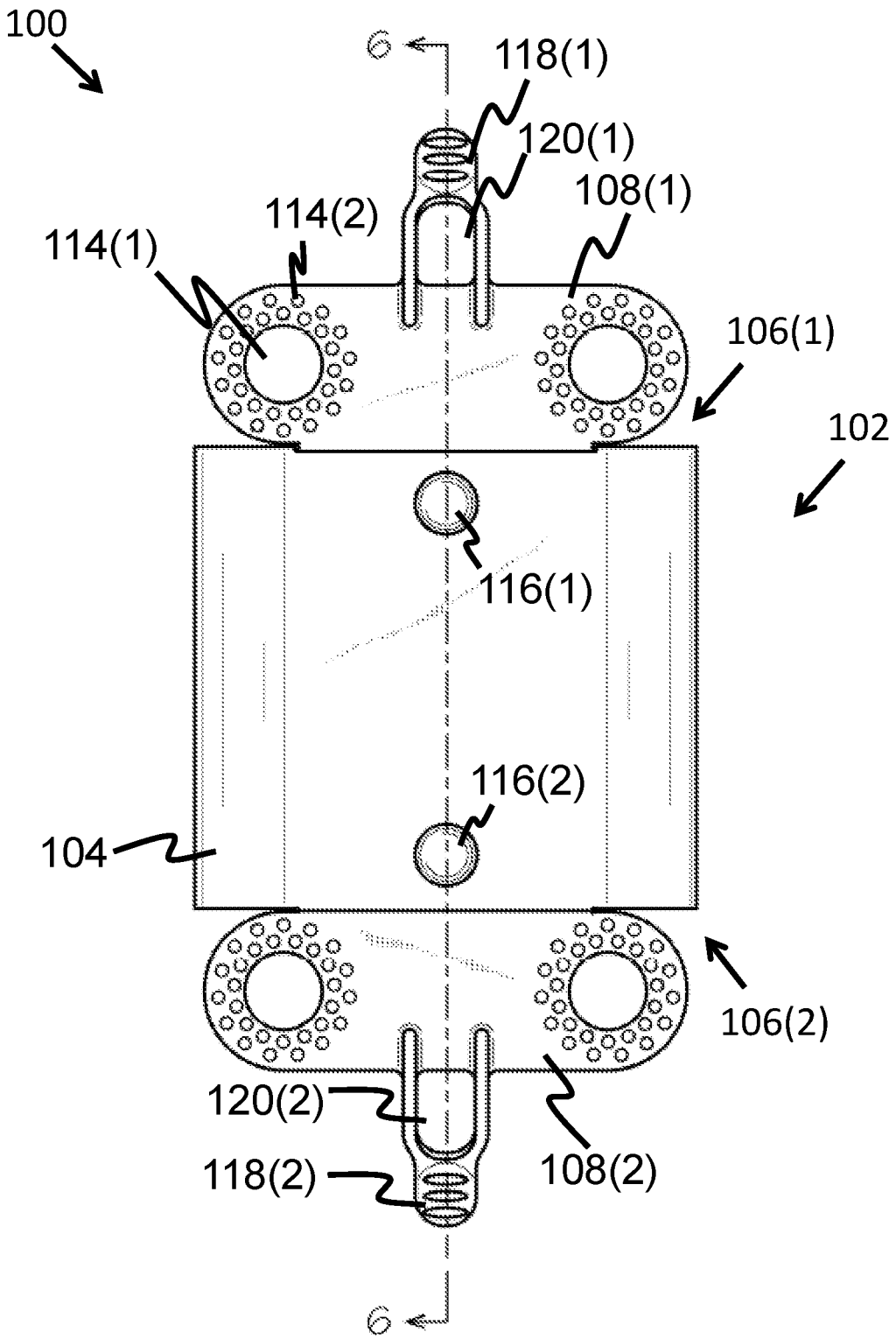
FIG. 2 is a front view illustrating one embodiment of a shower hair receptacle.

FIG. 1 and FIG. 2 depict an embodiment of a shower hair receptacle 100. As an overview, the shower hair receptacle 100 may include a sleeve 102. The sleeve 102 may include an enclosure 104. The sleeve 102 may include at least one opening 106 (e.g., as depicted in FIG. 1 and FIG. 2, a first opening 106(1) and a second opening 106(2)). The sleeve 102 may include at least one flap 108 (e.g., as depicted in FIG. 1 and FIG. 2, a first flap 108(1) and a second flap 108(2)). The at least one flap 108 may be selectively disposable over the at least one opening 106. The sleeve 102 may include a rake edge 110. The rake edge 110 may be disposed inside the enclosure 104. The shower hair receptacle 100 may include at least one adhesive 112. The at least one adhesive 112 may be disposed on a back side of an exterior portion of the sleeve 102.

Further details regarding the shower hair receptacle 100 are now discussed. In one or more embodiments, the shower hair receptacle 100 may include a sleeve 102. The sleeve 102 may include an enclosure 104. The enclosure 104 may include one or more walls that at least partially surround an area to form an interior of the enclosure 104. For example, as depicted in FIG. 1, the sleeve 102 may include a pouch structure.

In some embodiments, the sleeve 102 may include one or more openings 106. An opening 106 may be disposed in an end portion of the enclosure 104. For example, as depicted in FIG. 2, a first opening 106(1) may disposed in an upper portion of the enclosure 104, and a second opening 106(2) may be disposed in a lower portion of the enclosure 104. The upper portion may be disposed above the lower portion in response to the shower hair receptacle 100 being disposed in a position similar to the positions depicted in FIG. 1 and FIG. 2. The one or more openings 106 may allow a user to insert hair into the sleeve 102. For example, the user may form one or more strands of hair into a ball shape and may insert the hair into the enclosure 104 of the sleeve 102 via the opening 106(1).

In one embodiment, the sleeve 102 may include one or more flaps 108. A flap 108 may include a flap of material. A flap 108 may be hingedly connected to the enclosure 104. The flap 108 may be hingedly connected to the enclosure 104 at or near an opening 106. For example, as seen in FIG. 1, the first flap 108(1) may be hingedly disposed on the enclosure 104 near the first opening 106(1). The flap 108 may be selectively disposed over the opening 106 to prevent objects from entering the enclosure 104 via the opening 106 or to prevent objects disposed inside the enclosure 104 from escaping via the opening 106.

In some embodiments, the sleeve 102 may include a rake edge 110. The rake edge 110 may include structures, textures, surfaces, or other mechanisms for catching hair disposed in the enclosure 104 by a user, removing the hair from the gasp of the user, grasping the hair, and keeping the hair within the enclosure 104 after the user is no longer grasping the hair or has removed his or her hand from the enclosure 104. For example, as depicted in FIG. 1, the rake edge 110 may include one or more protrusions that may provide the friction or grasping. The one or more protrusions may include bristles. The one or more protrusions may include a saw-tooth shape, hooks, a stem with a small object on the end (such as a sphere, arrow, or other shape), or other shapes, sizes, or configurations. A stem or object at the end of the stem may include a rigid material or may include a flexible material.

In some embodiments, the hand of a user may insert hair into the opening 106 of the sleeve 102. The flap 108 may be in an open position and the hair may come in contact with the rake edge 110. The rake edge 110 may grab the hair and may hold the hair near the opening 106. Once the hand of the user is not supporting the hair, the hair may remain inside the enclosure 104. A user may insert multiple portions of hair into the enclosure 104.

The rake edge 110 may be disposed on an inner surface of the sleeve 102, for example, as depicted in FIG. 1, on one or more interior walls of the enclosure 104. In some embodiments, the rake edge 110 may be disposed along an entire side of the inside of the sleeve 102. In other embodiments, the rake edge 110 may be disposed only along a portion of the side of the inside of the sleeve 102. In one or more embodiments, the rake edge 110 may provide an amount of friction such that that the hair does not hang on the rake edge 110 and drops down inside the sleeve 102 when the hair is not held by the user.

Figure 3:
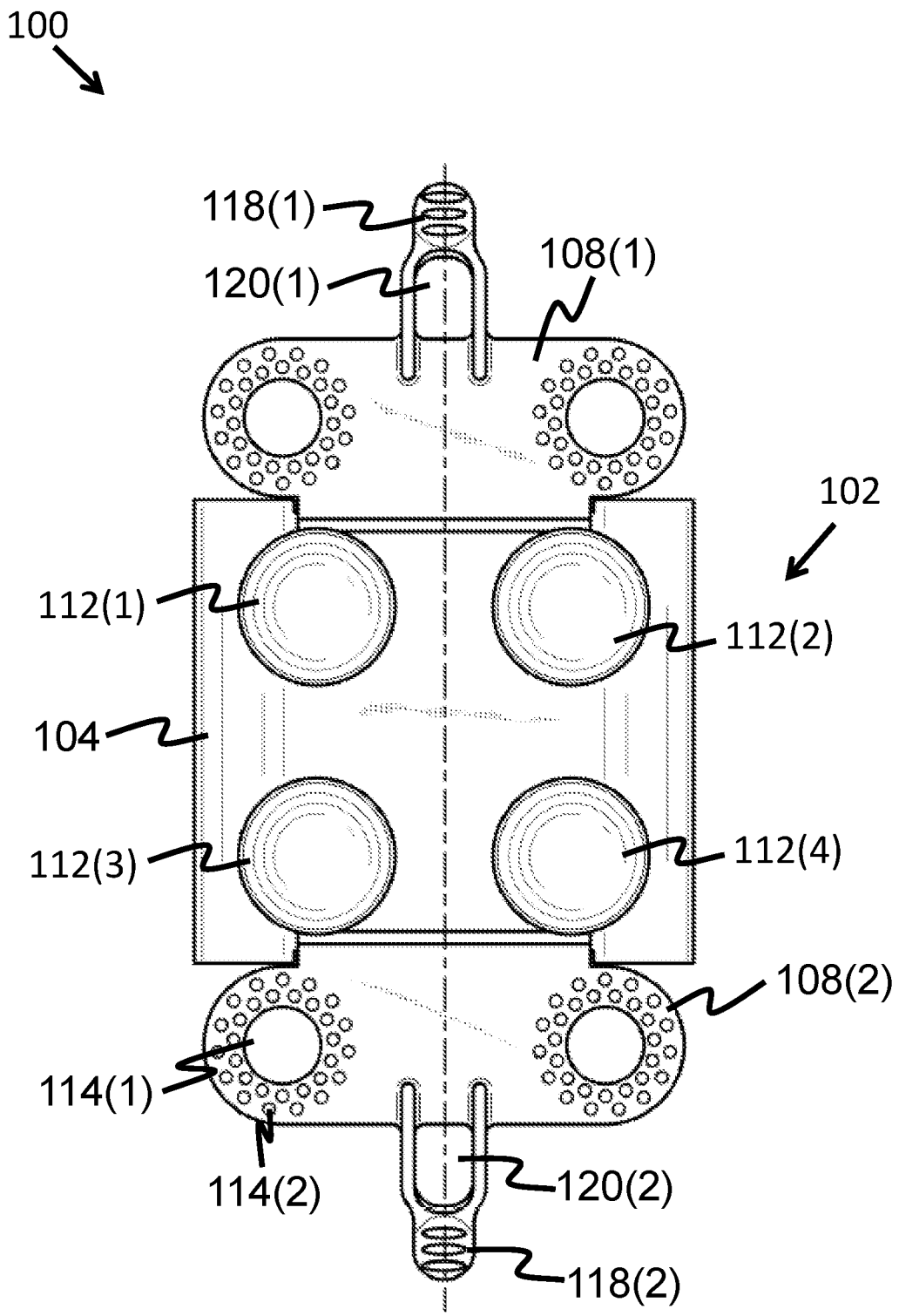
FIG. 3 is a back view illustrating one embodiment of a shower hair receptacle.

In one embodiment, the shower hair receptacle 100 may include at least one adhesive. The at least one adhesive 112 may include a suction cup, a magnet, and adhesive material (e.g., a paste), or some other coupling mechanism. For example, as depicted in FIG. 3, the at least one adhesive 112 may include one or more suction cups 302(1)-(4). In some embodiments, the at least one adhesive 112 may include a post, and the post may engage with an aperture or other structure on the shower wall or on a shower surface to hang the shower hair receptacle 100 from the shower wall or surface. In other embodiments, the at least one adhesive 112 may include a hook, aperture, or other structure by which the shower hair receptacle 100 may hang from a post of the shower wall or surface. In some embodiments, the shower hair receptacle 100 may not include an adhesive 112 and, instead, may be at rest (e.g., on a shelf or other surface).

In one embodiment, the shower hair receptacle 100 may include one or more types of material. For example, the shower hair receptacle 100 may include silicone, rubber, plastic, or some other type of material. The shower hair receptacle 100 may include a flexible material, a rigid material, or some other type of material. The material may be waterproof, water-resistant, or have other properties relating to water.

Figure 4:
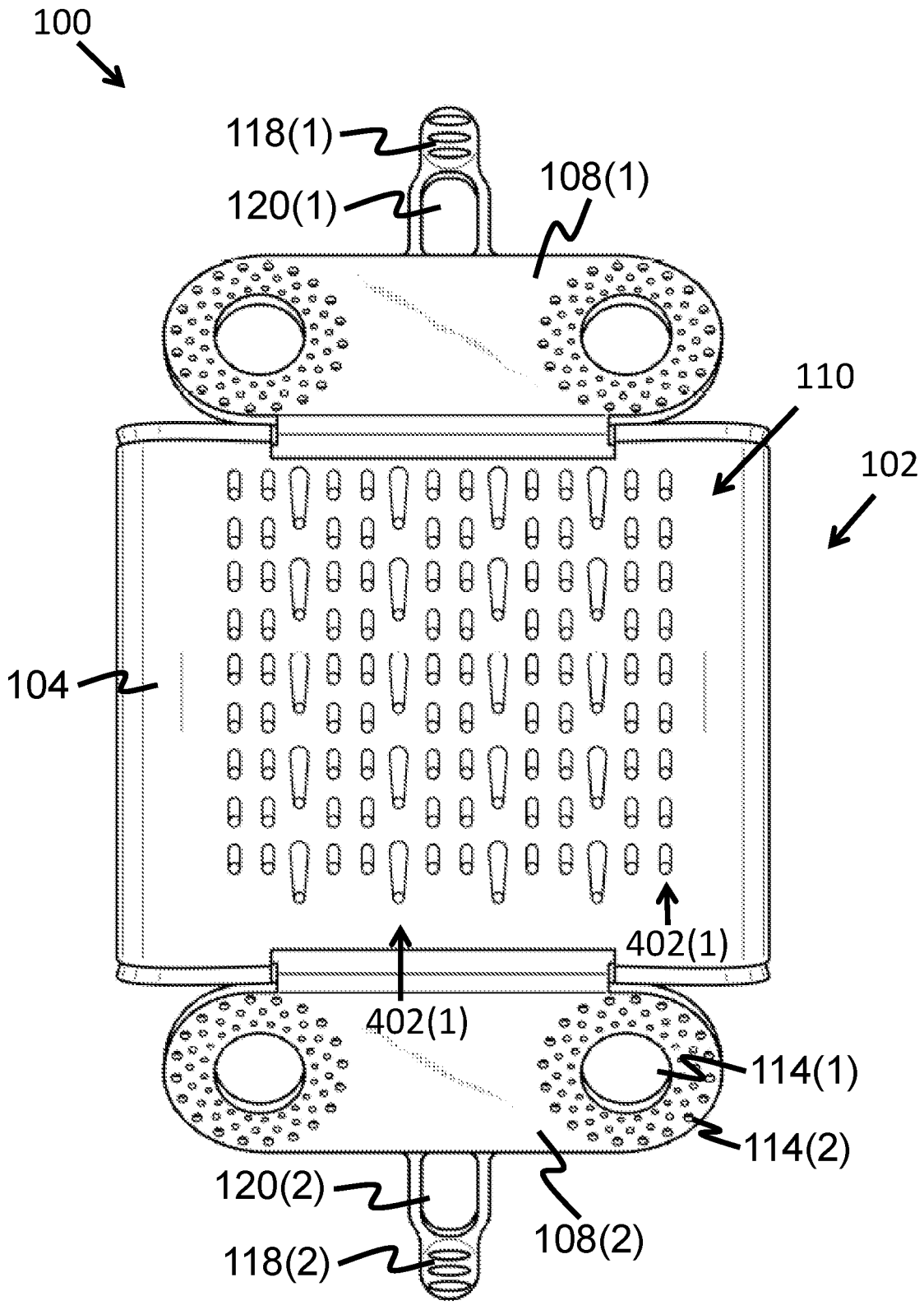
FIG. 4 is a front view illustrating one embodiment of a shower hair receptacle in an inside out configuration.

FIG. 4 depicts one embodiment of the shower hair receptacle 100 in an inside out configuration. In some embodiments, the shower hair receptacle 100 may be foldable inside out by the user. The user may fold the shower hair receptacle 100 inside out in order to gain access to the interior of the enclosure 104. The user may fold the shower hair receptacle 100 inside out in order to remove hair from the rake edge 110 in order to throw away the hair (e.g., in response to the enclosure 104 being full of hair).

As can also be seen in FIG. 4, the rake edge 110 may include one or more rows 402 of protrusions. Different rows 402 may include different numbers of protrusions. Different protrusions may be different widths, lengths, or other size configurations. For example, as depicted in FIG. 4, a first row 402(1) may include one or more protrusions of a first length, and a second row 402(2) may include one or more protrusions of a second length, and the first length and the second length may be different. For example, the first row 402(1) may include protrusions that are longer than the protrusions of the second row 402(2). In one embodiment, the first length may include a length of 0.63 inches (approx. 16.1 millimeters), and the second length may include a length of 0.27 inches (approx. 6.9 millimeters). As used herein, a "row" may include a line of protrusions in a vertical configuration, horizontal configuration, or slanted configuration, relative to the orientation of the shower hair receptacle 100 depicted in the Figures.

Figure 5:
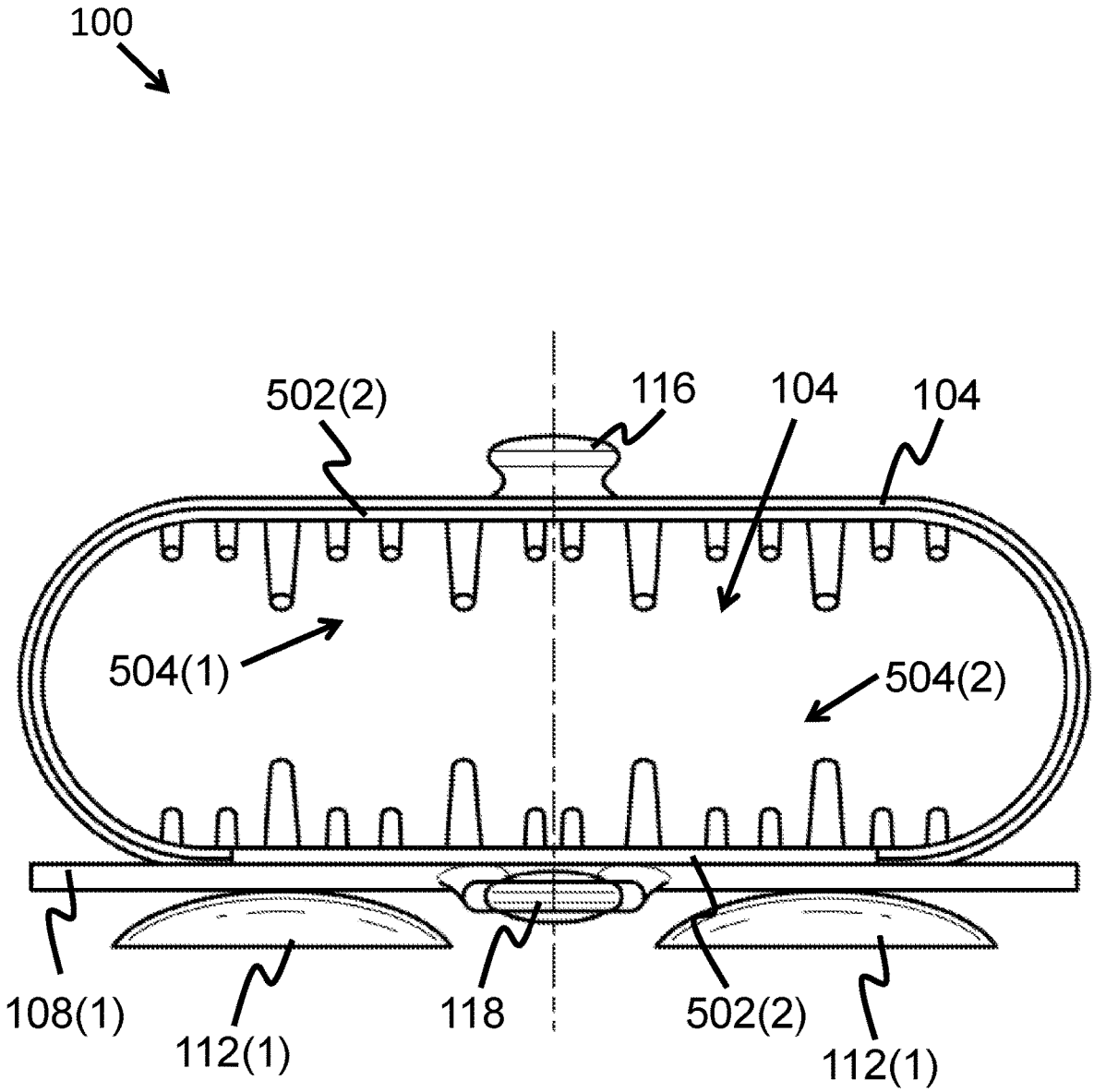
FIG. 5 is a top-down view illustrating one embodiment of a shower hair receptacle.

FIG. 5 depicts one embodiment of the shower hair receptacle 100. In some embodiments, the enclosure 104 may include a first interior wall 502(1) and a second interior wall 502(2). The first interior wall 502(1) may be disposed opposite the second interior wall 502(2). The first interior wall 502(1) may include the interior wall of the enclosure 104 nearer to the front of the sleeve 102. The second interior wall 502(2) may include the interior wall closer to the at least one adhesive 112. In some embodiments, the rake edge 110 may be disposed on both the first interior wall 502(1) and the second interior wall 502(2). For example, as depicted in FIG. 5, a first group of protrusions 504(1) may be disposed on the first interior wall 502(1), and a second group of protrusions 504(2) may be disposed on the second interior wall 502(2).

Figure 6:
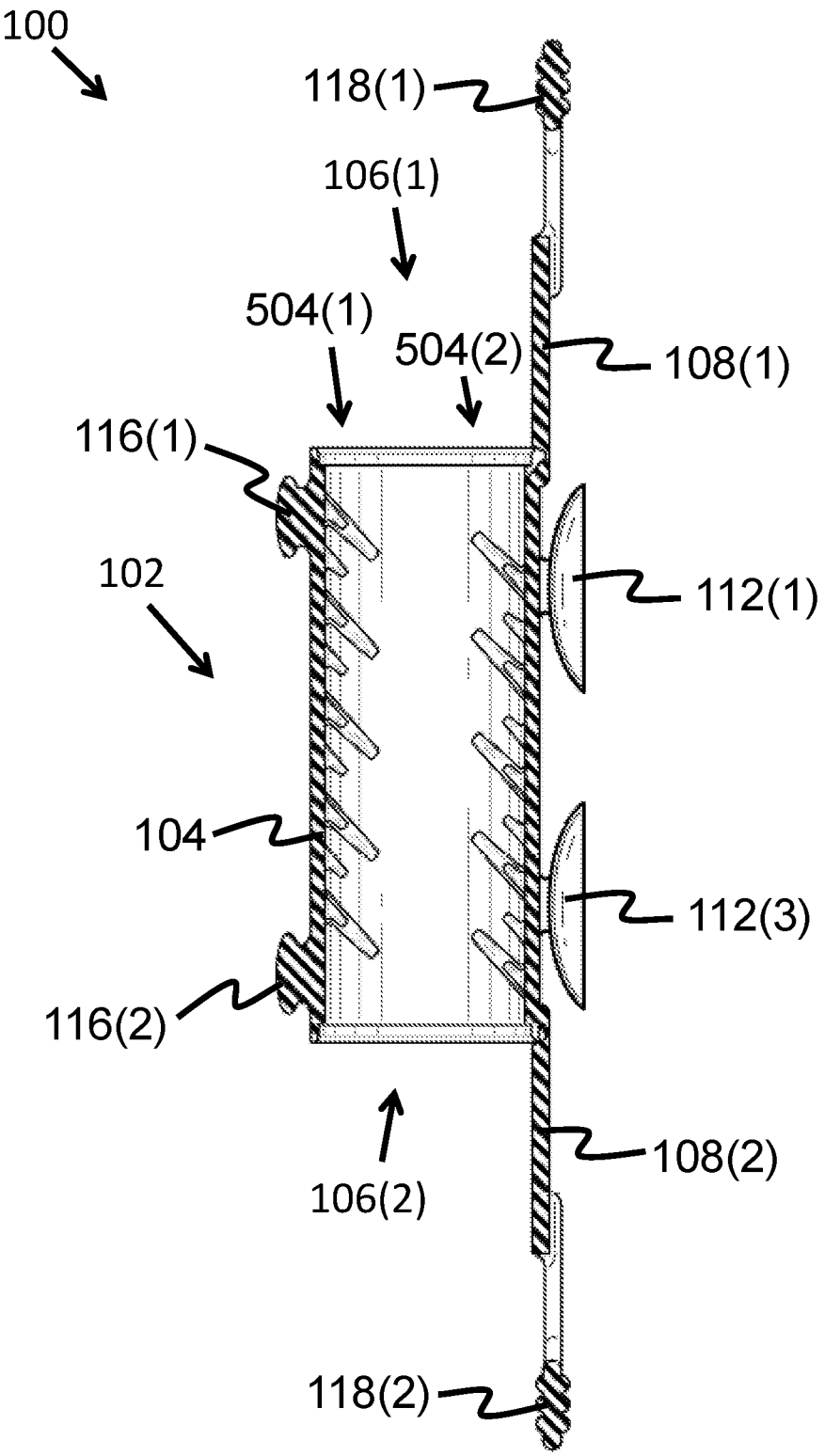
FIG. 6 is a cutaway side view illustrating one embodiment of a shower hair receptacle.

As depicted in FIG. 6, in one embodiment, the first group of protrusions 504(1) may be disposed at an upward angle. The second group of protrusions 504(2) may be disposed at a downward angle. In other embodiments, the first group of protrusions 504(1) may be disposed at a downward angle, and the second group of protrusions 504(2) may be disposed at an upward angle. An angle may be relative to a horizontal plane when the hair shower receptacle is oriented in the position depicted in FIGS. 1-6. The angle of a protrusion may be between 0 and 180 degrees. In some embodiments, the protrusions of the different groups of protrusions 504(1)-(2) may be angled in opposite directions of each other, as depicted in FIG. 6. In some embodiments, the groups of protrusions 504(1)-(2) may be angled in the same direction. In some embodiments, different protrusions on the same interior wall 502 may be oriented at different angles from each other.

In some embodiments, the sleeve 102 may include one or more apertures 114. For example, as seen in FIG. 1, FIG. 2, FIG. 3, and FIG. 4, the one or more flaps 108 may include one or more apertures 114 disposed within them. The one or more apertures 114 may allow for venting of the sleeve 102. The one or more apertures 114 may allow for drainage and drying of the sleeve 102. The one or more apertures 114 may allow water to drain out of the sleeve 102. The one or more apertures 114 may include different sizes or shapes. An aperture 114 may include a round hole, a rectangular slit, or another shape. For example, as seen in FIG. 1, FIG. 2, FIG. 3, and FIG. 4, the one or more apertures 114 may include some large round holes 114(1) and some smaller round holes 114(2). The one or more apertures 114 may be sized such that water can drain through them, but the hair disposed in the enclosure 104 may not escape out of the one or more apertures 114. In some embodiments, the enclosure 104 may include one or more apertures 114 to allow for air circulation or water drainage.

In one embodiment, the shower hair receptacle 100 may include a closure button 116. The closure button 116 may be disposed on a front side of the exterior portion of the enclosure 104. The shower hair receptacle 100 may include a first closure button 116(1) and a second closure button 116(2). The first closure button 116(1) may be disposed near the first opening 106(1), and the second closure button 116(2) may be disposed near the second opening 106(2). A flap 108 may further include a tab 118, for example, a first tab 118(1) that extends from first flap 108(1) and a second tab 118(2) that extends from second flap 108(2). The tab 118 may extend from the flap 108. The tab 118 may include a piece of material by which the user may grasp the flap 108. The tab 118 may include one or more small ridges that may assist the user in grasping the tab 118.

In some embodiments, the tab 118 may include aperture 120, for example, a first aperture 120(1) included with first tab 118(1), and a second aperture included within second tab 118(2). The aperture 120 may be selectably disposable over the closure button 116 in response to the flap 108 being disposed over the opening 106. The closure button 116 and tab 118 may selectably hold the flap 108 in a closed position to prevent objects from entering or escaping the enclosure 104. In some embodiments, the shower hair receptacle 100 may include magnets, a hook and loop, a tie string, or other mechanisms to selectably hold the flap 108 in the closed position.

In some embodiments, the height of the sleeve 102 (i.e., the distance from the first opening 106(1) to the second opening 106(2)) may be substantially equal to 4.75 inches (approx. 120.7 millimeters). In one embodiment, the width of the sleeve 102 may be substantially equal to 5.12 inches (approx. 130 millimeters). In certain embodiments, the depth of the sleeve 102 (i.e., the distance from the first interior wall 502(1) to the second interior wall 502(2)) may be substantially equal to 1.99 inches (approx. 50.5 millimeters). In some embodiments, the total depth of the shower hair receptacle 100 (i.e., the distance from the front of the closure button 116 to the end of the adhesive 112) may be substantially equal to 2.43 inches (approx. 61.8 millimeters). In one embodiment, the total height of the shower hair receptacle 100 (i.e., the distance between the most distal points of the tabs 118(1), 118(2)) may be substantially equal to 11.22 inches (approx. 284.9 millimeters). In some embodiments, one or more of these distances may include a distance shorter or longer than those disclosed above.

In certain embodiments, in response to a user squeezing the sides of the sleeve 102, a flap 108 may move into an open position. The flap 108 being in the open position may allow the user to place hair in the sleeve 102 via an opening 106. In response to no force being exerted on the sides of the sleeve 102, the flap 108 may move into a closed position. Although the one or more flaps 108 have been depicted as attached to a back side of the sleeve 102 (i.e., the side of the sleeve 102 disposed near the one or more adhesives 112), a flap 108 may attach to a side of the sleeve 102 or the front side of the sleeve 102. In some embodiments, a flap 108 may be in a closed position when the sleeve 102 is at rest (i.e., when no force is exerted on the sides of the sleeve 102). In one embodiment, a flap 108 may be in an open position when the sleeve 102 is at rest.

In some embodiments, the shower hair receptacle 100 may include a strap. The strap may protrude out of the upper portion of the sleeve 102. The strap may allow the shower hair receptacle 100 to hang from a shower neck attached to a shower head. The strap may allow the shower hair receptacle 100 to hang from a shower caddy or other shower implement. In one embodiment, an end of the strap may include a post, and the post may protrude through an aperture of the shower hair receptacle 100. The aperture may include the aperture 120. The aperture may include an aperture disposed in another portion of the shower hair receptacle 100. In another embodiment, the end of the strap may include the aperture, and another portion of the shower hair receptacle 100 may include the post. In some embodiments, the strap may include multiple posts or apertures such that the size of the strap may be adjustable.

Figure 7:
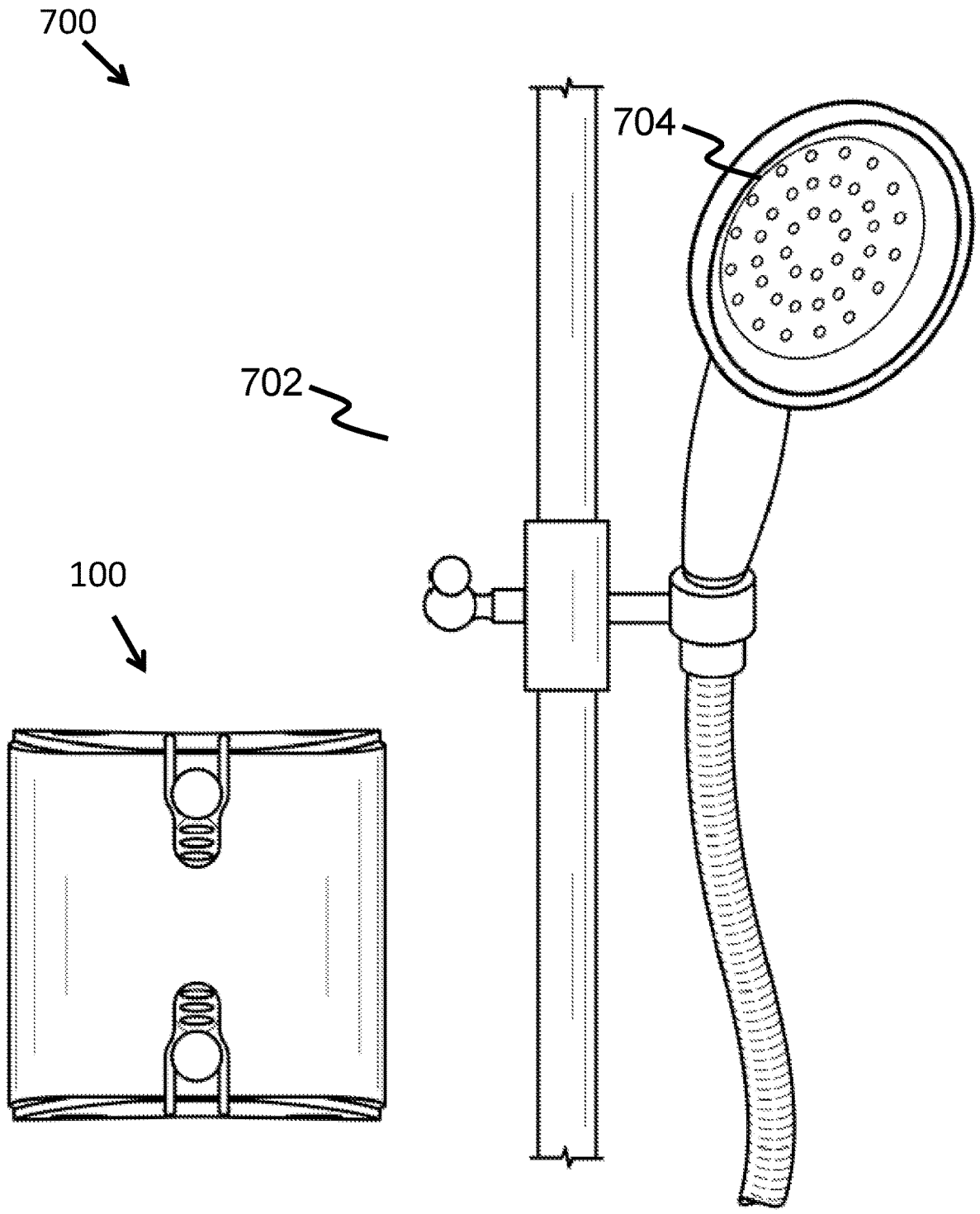
FIG. 7 is a front view illustrating one embodiment of a shower hair receptacle disposed in a shower.

FIG. 7 depicts one embodiment of the shower hair receptacle 100 disposed on a shower wall 702. The shower wall 702 may be located near a shower head 704. In some embodiments, the shower hair receptacle 100 may selectively couple to a wall (e.g., a shower wall 702). In one embodiment, the shower hair receptacle 100 may be disposable in another portion of a shower such as on a shower caddy, on a shelf of the shower, or in another location. In one embodiment, a user may remove the shower hair receptacle 100 from the shower area and may take the shower hair receptacle 100 to a trash receptacle. The user may remove hair from the shower hair receptacle 100 and dispose of it in the trash receptacle.

Figure 8:
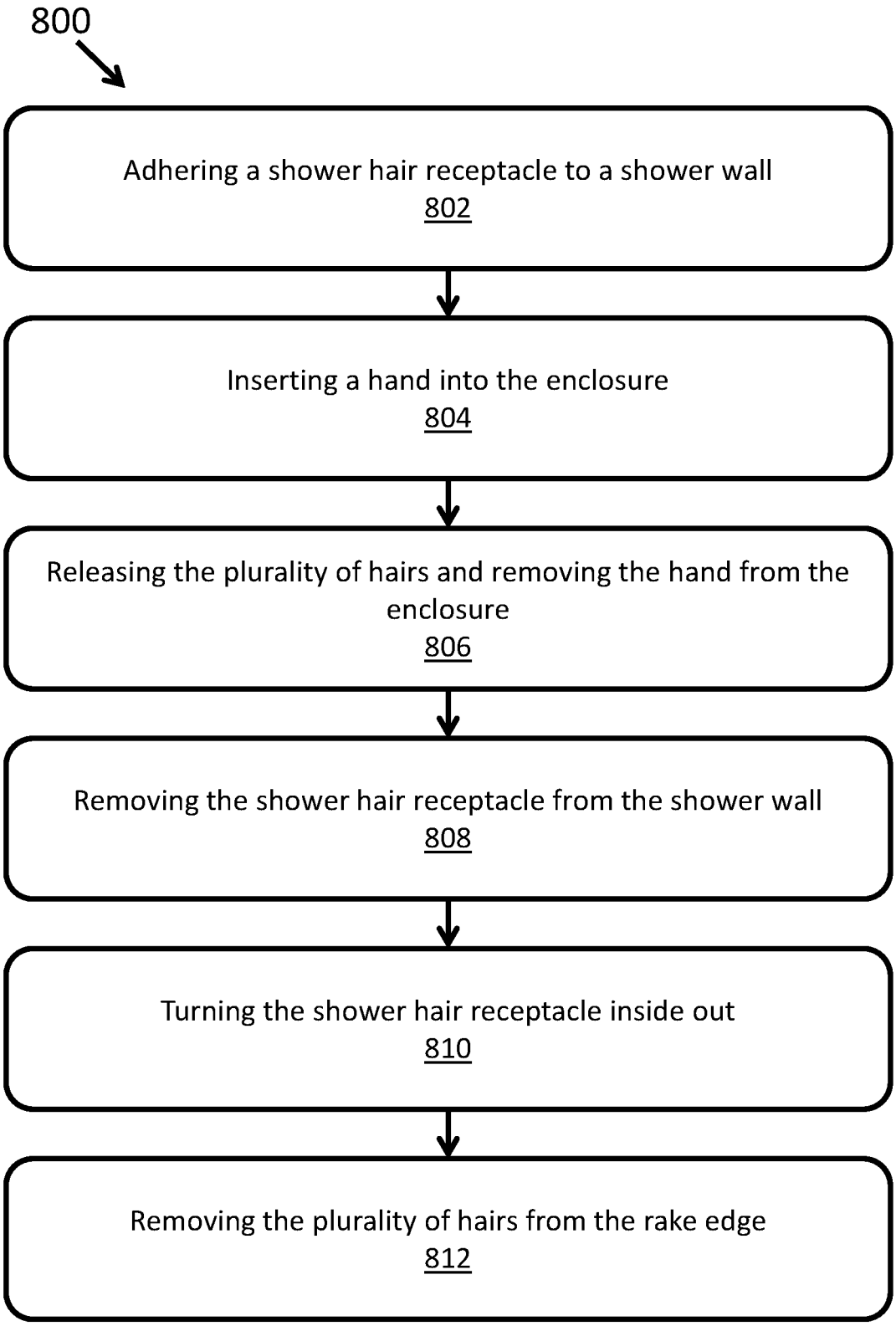
FIG. 8 is a flowchart diagram illustrating one embodiment of a method for operating a shower hair receptacle.

FIG. 8 depicts one embodiment of a method 800. The method 800 may include a method for operating a shower hair receptacle 100. The method 800 may include adhering a shower hair receptacle 100 to a shower wall 702 (step 802). The shower hair receptacle 100 may include a sleeve 102. The sleeve 102 may include an enclosure 104, at least one opening 106 in the enclosure 104, at least one flap 108 selectively disposable over the at least one opening 106, or a rake edge 110 disposed inside the enclosure 104. The shower hair receptacle 100 may include at least one adhesive 112 disposed on a back side of an exterior portion of the sleeve 102. In one embodiment, the shower hair receptacle 100 may include a shower hair receptacle 100 similar to those discussed above.

The method 800 may include inserting a hand into the enclosure 104 through the at least one opening 106 (step 804). The hand may selectively grasp a plurality of hairs. The method 800 may include releasing the plurality of hairs and removing the hand from the enclosure 104 (step 806). The rake edge 110 may be operable to grasp the plurality of hairs. The method 800 may include removing the shower hair receptacle 100 from the shower wall 702 (step 808). The method 800 may include turning the shower hair receptacle 100 inside out (step 810). The method 800 may include removing the plurality of hairs from the rake edge 110 (step 812).

In one embodiment, turning the shower hair receptacle 100 inside out (step 810) may include the user turning the shower hair receptacle 100 (or at least a portion of the shower hair receptacle 100, such as the sleeve 102) inside out. The user may turn the shower hair receptacle 100 inside out (step 810) to clean out the hair from the inside of the sleeve 102. The user may turn the shower hair receptacle 100 inside out by applying force to a lower portion of the sleeve 102 and forcing the lower portion of the sleeve 102 up through an opening 106(1) in the upper portion of the sleeve 102. The user may turn the shower hair receptacle 100 inside out by applying force to an upper portion of the sleeve 102 and forcing the upper portion of the sleeve down through an opening 106(2) in the lower portion of the sleeve 102. This may expose the formerly interior portion of the enclosure 104 and allow the user to remove the hair from rake edge 110. The user may then restore the sleeve 102 back to its original formation and replace the shower hair receptacle 100 in the shower area.

In one or more embodiments, the apparatuses, systems, and methods disclosed herein may provide a shower hair receptacle 100 that may enclose hair within an enclosure 104 of a sleeve 102 such that the hair is hidden from the view of a user. This may help keep a shower area clean and may provide a place to store hair until the user is ready to dispose of the hair. Furthermore, the rake edge 110 of the shower hair receptacle 100 may grab hair from the user's hand and pull the hair off of the user's hand or fingers as the user inserts his or her hand into the enclosure 104 or removes his or her hand from the enclosure 104.

Thus, although there have been described particular embodiments of the present disclosure of a new and useful SHOWER HAIR RECEPTACLE, it is not intended that such references be construed as limitations upon the scope of this disclosure.

What is claimed is:

1. A shower hair receptacle, comprising:
a sleeve, comprising
an enclosure,
at least one opening in the enclosure,
at least one flap selectively disposable over the at least one opening, and
a rake edge disposed inside the enclosure,
wherein the rake edge catches hair disposed in the enclosure by a user and removes the hair from the grasp of the user.

2. The shower hair receptacle of claim 1, wherein the rake edge comprises at least a row of protrusions.

3. The shower hair receptacle of claim 2, wherein the at least a row of protrusions comprises a plurality of rows of protrusions.

4. The shower hair receptacle of claim 3, wherein:
the plurality of rows of protrusions comprises a first row of protrusions and a second row of protrusions;
the first row of protrusions includes a first length, and the second row of protrusions includes a second length; and
the first length is different from the second length.

5. The shower hair receptacle of claim 1, wherein:
the enclosure includes a first interior wall and a second interior wall, wherein the first interior wall is disposed opposite the second interior wall; and
the rake edge includes
a first plurality of protrusions disposed on the first interior wall, and
a second plurality of protrusions disposed on the second interior wall.

6. The shower hair receptacle of claim 5, wherein:
the first plurality of protrusions are disposed at a downward angle; and
the second plurality of protrusions are disposed at an upward angle.

7. The shower hair receptacle of claim 1, wherein:
the at least one opening includes a first opening and a second opening; and
the at least one flap comprises
a first flap selectably disposable over the first opening, and
a second flap selectably disposable over the second opening.

8. The shower hair receptacle of claim 7, wherein:

the first opening is disposed in an upper portion of the enclosure; and the second opening is disposed in a lower portion of the enclosure.

9. The shower hair receptacle of claim 1, wherein:

the enclosure further includes a closure button disposed on a front side of the exterior portion of the enclosure; and the at least one flap further includes a tab extending from the at least one flap, wherein the tab includes an aperture, and the aperture is selectably disposable over the closure button in response to the at least one flap being disposed over the at least one opening.

10. The shower hair receptacle of claim 1, wherein the at least one flap comprises at least one aperture disposed in the at least one flap.

11. The shower hair receptacle of claim 10, wherein the at least one aperture comprises a plurality of apertures.

12. The shower hair receptacle of claim 1, wherein the at least one flap being selectively disposable over the at least one opening comprises the at least one flap being hingedly connected to the enclosure at the at least one opening.

13. The shower hair receptacle of claim 1, wherein:

the enclosure comprises a flexible material; and the enclosure is foldable inside out in response to manipulation by the user.

14. A shower hair receptacle, comprising:

a sleeve, comprising an enclosure, including an upper portion and a lower portion, wherein the upper portion is disposed above the lower portion, a first opening disposed in the upper portion of the enclosure, a second opening disposed in the lower portion of the enclosure, a first flap selectively disposable over the first opening, a second flap selectively disposable over the second opening, a rake edge disposed inside the enclosure, wherein the rake edge includes a first plurality of protrusions disposed on a first interior wall of the enclosure, and a second plurality of protrusions disposed on a second interior wall of the enclosure, wherein the rake edge catches hair disposed in the enclosure by a user and removes the hair from the grasp of the user.

15. The shower hair receptacle of claim 14, wherein:

the first plurality of protrusions are disposed at a downward angle; and the second plurality of protrusions are disposed at an upward angle.

16. The shower hair receptacle of claim 14, wherein:

the enclosure further includes a first closure button and a second closure button;

the first closure button is disposed on a front side of an exterior portion of the upper portion of the enclosure;

the second closure button is disposed on a front side of an exterior portion of the lower portion of the enclosure; and each of the first flap and the second flap further includes a tab extending from the respective flap, wherein the tab includes an aperture, and the aperture is selectably disposable over the respective closure button in response to the first flap or the second flap being disposed over the respective opening.

17. The shower hair receptacle of claim 14, wherein each of the first flap and the second flap comprises a plurality of apertures disposed in the respective flap.

18. The shower hair receptacle of claim 14, wherein:

the first flap being selectively disposable over the first opening includes the first flap being hingedly connected to the enclosure at the first opening; and the second flap being selectively disposable over the second opening includes the second flap being hingedly connected to the enclosure at the second opening.

19. A method of operating a shower hair receptacle, comprising:

disposing a shower hair receptacle in a shower, wherein the shower hair receptacle includes a sleeve, including an enclosure, at least one opening in the enclosure, at least one flap selectively disposable over the at least one opening, and a rake edge disposed inside the enclosure;

inserting a hand into the enclosure through the at least one opening, wherein the hand selectively grasps a plurality of hairs;

releasing the plurality of hairs and removing the hand from the enclosure, wherein the rake edge is operable to grasp the plurality of hairs;

removing the shower hair receptacle from the shower;

turning the shower hair receptacle inside out; and removing the plurality of hairs from the rake edge.

* * * * *